US008490845B2

(12) United States Patent
Stewart

(10) Patent No.: US 8,490,845 B2
(45) Date of Patent: Jul. 23, 2013

(54) BELT MOUNTED TOOL HOLDER

(76) Inventor: Tucson Allan Stewart, Laveen, AZ (US)

( * ) Notice: Subject to any disclaimer, the term of this patent is extended or adjusted under 35 U.S.C. 154(b) by 181 days.

(21) Appl. No.: 12/700,553

(22) Filed: Feb. 4, 2010

(65) Prior Publication Data

US 2010/0133305 A1 Jun. 3, 2010

Related U.S. Application Data

(62) Division of application No. 11/348,421, filed on Mar. 20, 2006, now abandoned.

(51) Int. Cl.
*B65D 25/52* (2006.01)

(52) U.S. Cl.
USPC ..... 224/197; 224/674; 224/904

(58) Field of Classification Search
USPC ..... 224/197, 674, 904; 7/166, 167; D8/26
See application file for complete search history.

(56) References Cited

U.S. PATENT DOCUMENTS

| | | | | | |
|---|---|---|---|---|---|
| 441,979 | A * | 12/1890 | Rohrbach | 7/166 |
| 953,138 | A * | 3/1910 | Hale | 7/166 |
| 1,508,489 | A * | 9/1924 | Vlchek | 254/25 |
| 1,828,142 | A * | 10/1931 | Herdman | 7/138 |
| 3,641,846 | A * | 2/1972 | Prial | 81/106 |
| 4,020,985 | A * | 5/1977 | Halterman | 224/251 |
| 4,106,679 | A * | 8/1978 | Hillinger | 224/197 |
| 4,424,923 | A * | 1/1984 | Bingham | 224/251 |
| 4,745,651 | A * | 5/1988 | Schellenger | 7/158 |
| 4,884,730 | A * | 12/1989 | Carpenter | 224/162 |
| 5,673,830 | A * | 10/1997 | Matthews | 224/268 |
| 5,695,104 | A * | 12/1997 | Darling | 224/684 |
| 5,938,177 | A * | 8/1999 | Fonda | 254/25 |
| 6,062,449 | A * | 5/2000 | Kahn | 224/268 |
| 6,257,553 | B1 * | 7/2001 | Khachatoorian | 254/25 |
| 6,901,621 | B2 * | 6/2005 | Bruneau | 7/166 |
| 6,901,823 | B2 * | 6/2005 | Ernesti | 81/60 |
| 7,726,713 | B2 * | 6/2010 | Oleksia | 294/24 |
| 7,735,172 | B2 * | 6/2010 | Newton et al. | 7/166 |
| 7,735,806 | B2 * | 6/2010 | Prater et al. | 254/25 |
| 2004/0129388 | A1 * | 7/2004 | Brazil | 157/1.3 |
| 2004/0149967 | A1 * | 8/2004 | Puopolo et al. | 254/25 |
| 2005/0081685 | A1 * | 4/2005 | Ernesti | 81/60 |
| 2005/0087729 | A1 * | 4/2005 | Mitcheltree | 254/25 |
| 2009/0094757 | A1 * | 4/2009 | Newton et al. | 7/166 |
| 2011/0023237 | A1 * | 2/2011 | Simmons | 7/117 |
| 2011/0119836 | A1 * | 5/2011 | Tygh | 7/166 |

* cited by examiner

*Primary Examiner* — Nathan J Newhouse
*Assistant Examiner* — Peter Helvey
(74) *Attorney, Agent, or Firm* — Parsons & Goltry; Robert A. Parsons; Michael W. Goltry

(57) ABSTRACT

A belt mounted sleever bar holder includes a belt receiving member of flexible material formed into a belt receiving loop and designed to receive a belt therethrough so as to securely hold the belt receiving member on a belt. A metal mounting plate is fixedly attached to an outer surface of the belt receiving member and an L-shaped metal sleever bar receiving member with a substantially vertically oriented arm and a substantially horizontally oriented arm is pivotally attached parallel with an outer surface of the mounting plate for limited rotary movements of the vertical arm relative to the mounting plate. The horizontally oriented arm includes a sleever bar receiving opening therethrough.

1 Claim, 3 Drawing Sheets

BELT MOUNTED TOOL HOLDER

CROSS-REFERENCE TO RELATED APPLICATIONS

This application is a divisional application of currently U.S. application Ser. No. 11/348,421, filed 20 Mar. 2006 now abandoned.

FIELD OF THE INVENTION

This invention generally relates to a belt mounted tool holder and more specifically to a sleever bar holder.

BACKGROUND OF THE INVENTION

Belt mounted tool holders are used by workers in many industries to conveniently and quickly hold various tools in a ready state. Generally, the tool holders temporarily hold designated tools out of the way of work or movement but in a position to be quickly retrieved to perform tasks for which the tools are carried. In many instances, prior art tool holders don't distribute the weight or allow movement of the held tool so that the worker can move easily and so that other tools can be conveniently carried.

In a typical example, union iron workers use sleever bars as a standard tool of choice. Sleever bars shapes including hexagonal and round cross-sections. Also, the sleever bars are made by the industry in different lengths. Thus, any sleever bar holder must account for the different shaped cross-sections as well as the different lengths. The utility and design of current bar holders are lacking in that there are many in the field that are custom made that do not stand up to the test, or requirements, in the field.

It would be highly advantageous, therefore, to remedy the foregoing and other deficiencies inherent in the prior art.

Accordingly, it is an object of the present invention to provide a new and improved belt mounted tool holder.

It is another object of the present invention to provide a new and improved belt mounted tool holder that is designed to receive and hold a variety of tools with different lengths and cross-sections.

It is another object of the present invention to provide a new and improved belt mounted tool holder designed to receive and hold a variety of sleever bars therein.

It is another object of the present invention to provide a new and improved belt mounted tool holder designed to allow swiveling movement of a tool held therein to enable easy access and pulling rather than lifting movements during extraction of the tool.

SUMMARY OF THE INVENTION

The above objects and others are realized in a belt mounted tool holder including a belt receiving member formed with an opening designed to receive a belt therethrough so as to securely hold the belt receiving member on a belt. A mounting plate is fixedly attached to an outer surface of the belt receiving member. An L-shaped tool receiving member, having a first arm and a substantially perpendicularly oriented second arm, is pivotally attached parallel with an outer surface of the mounting plate for limited rotary movements of the first arm relative to the mounting plate. The second arm includes a tool receiving opening therethrough.

BRIEF DESCRIPTION OF THE DRAWING

The foregoing and further and more specific objects and advantages of the instant invention will become readily apparent to those skilled in the art from the following detailed description of a preferred embodiment thereof taken in conjunction with the drawings in which.

DETAILED DESCRIPTION OF A PREFERRED EMBODIMENT

Figure 1:
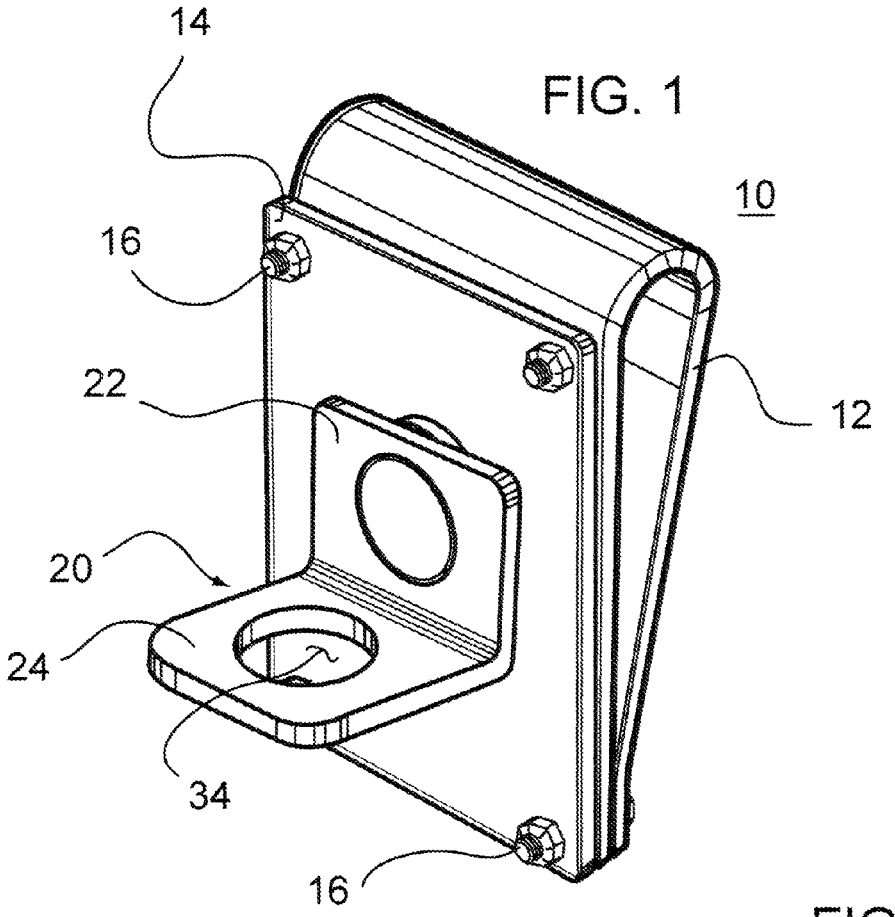
FIG. 1 is a perspective view of a belt mounted tool holder in accordance with the present invention.
Figure 2:
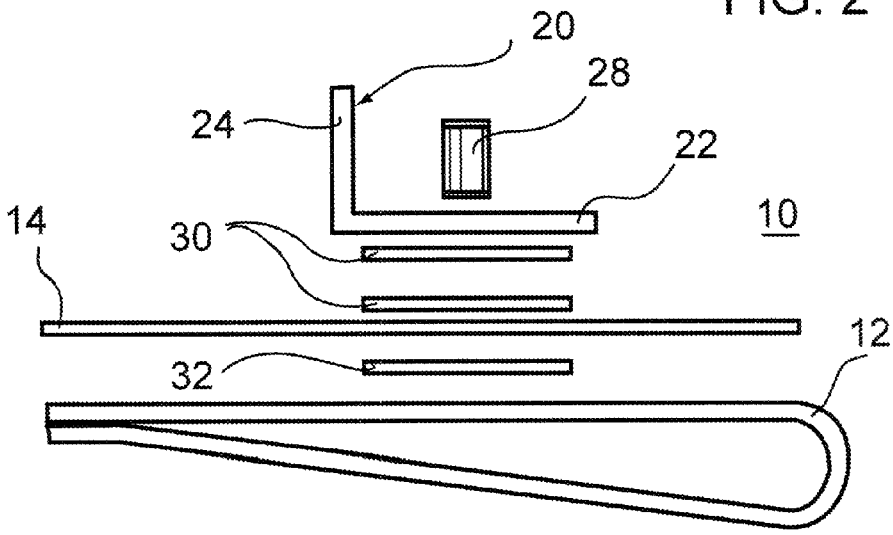
FIG. 2 is an exploded side view of the belt mounted tool holder of FIG. 1.

Turning to the drawings in which like characters indicate like parts throughout, FIG. 1 is a perspective view of a belt mounted tool holder 10 in accordance with the present invention. Referring additionally to FIG. 2, the various components of tool holder 10 are illustrated in more detail. Tool holder 10 includes a belt receiving member 12 designed to receive a belt therethrough so as to be securely held on the belt. In this preferred embodiment receiving member 12 is an elongated strap of a strong flexible material formed into a loop designed to extend around an individual's belt. The strap is preferably constructed of leather because of the natural conformation and strength. However, it will be understood that receiving member 12 could be formed of other strong materials, such as plastic, etc. and might be permanently formed into a loop or belt receiving opening.

Tool holder 10 further includes a mounting plate 14, which in this preferred embodiment is constructed of some very strong material, such as steel, etc. Mounting plate 14 is fixedly attached to an outer surface of receiving member 12 by some convenient means, such as the four affixing members 16 engaged through mounting plate 14 and at least one side of receiving member 12. In this preferred embodiment, affixing members 16 can be rivets, bolts, screws, etc. and the top two (in FIG. 1) extend only through the adjacent side of receiving member 12 while the bottom two extend through both sides of receiving member 12 and hold the strap in the loop configuration. It will be understood by those skilled in the art that receiving member 12 and mounting plate 14 could be formed as a single integral unit.

Figure 3:
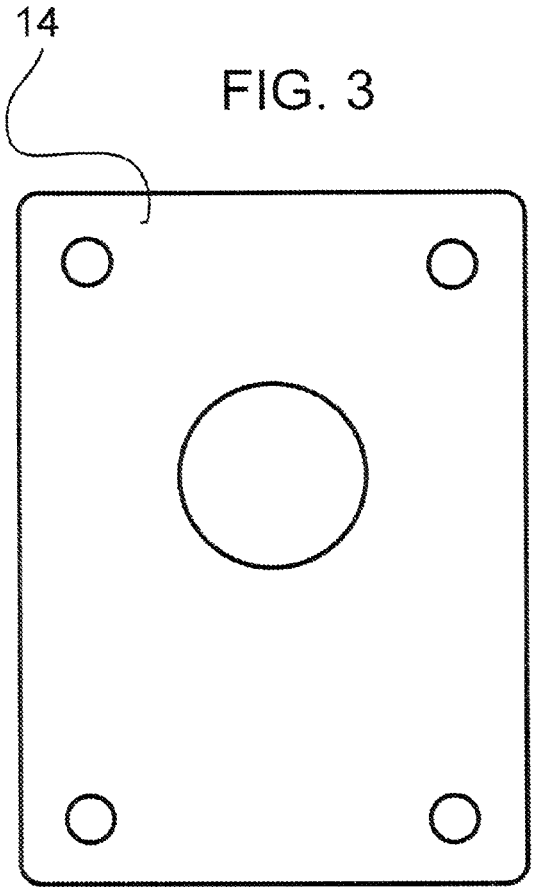
FIGS. 3 and 4 are front views of components of the belt mounted tool holder illustrated in FIG. 2.

Tool holder 10 further includes an L-shaped tool receiving member 20 having a substantially vertically oriented arm 22 and a substantially horizontally oriented arm 24 (in FIG. 1). Vertically oriented arm 22 is pivotally attached parallel with the outer surface of mounting plate 14 with arm 24 extending outwardly generally perpendicular thereto. Arm 22 is pivotally attached in this preferred embodiment by a pivot pin 28 (see FIG. 2) that extends through arm 22 of tool receiving member 20, one or more washers 30 and mounting plate 14. As can be seen in FIG. 3, an opening is provided through mounting plate 14 for receiving pivot pin 28 therethrough. Pivot pin 28 can be a simple pin that is riveted or flattened at each end to hold the entire assembly in place or it can be a bolt, screw, etc. In any of these structures, pivot pin 28 is secured to allow pivotal movement of receiving member 20 relative to mounting plate 14 without allowing axial or separating movements thereof. Also in this embodiment a washer 32 is placed between mounting plate 14 and belt receiving member 12 to separate the inner end of pivot pin 28 from the surface of belt receiving member 12 to prevent damage to belt receiving member 12 during pivotal movements of pivot pin 28.

Figure 4:
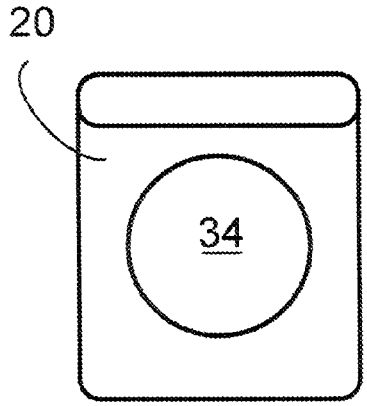
Figure 5:
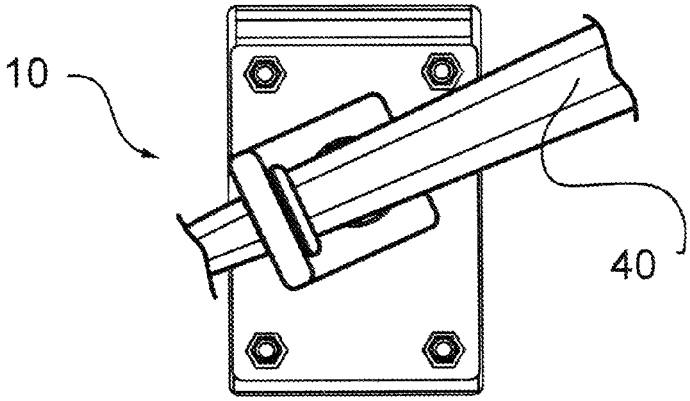
FIG. 5 is a front view of the belt mounted tool holder of FIG. 1, portions thereof removed for clarity, illustrating the insertion and or removal of a tool therefrom.
Figure 6:
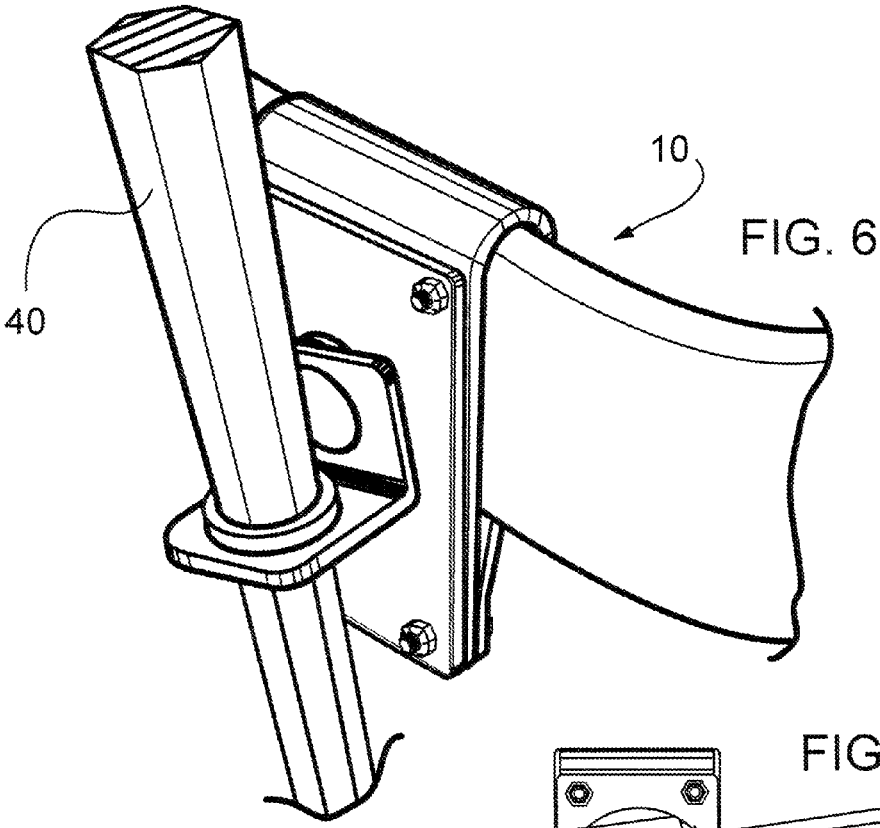
FIG. 6 is an enlarged perspective view of the tool holder of FIG. 1 mounted on a belt and holding a tool therein.
Figure 8:
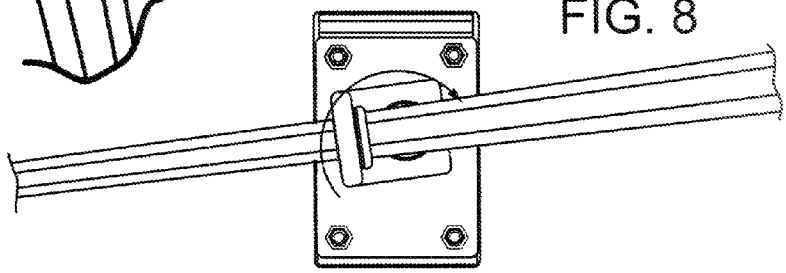
FIGS. 7 and 8 are front views of the belt mounted tool holder of FIG. 1, portions thereof removed for clarity, illustrating the pivotal movement thereof from substantially one extreme to the other.
Figure 7:
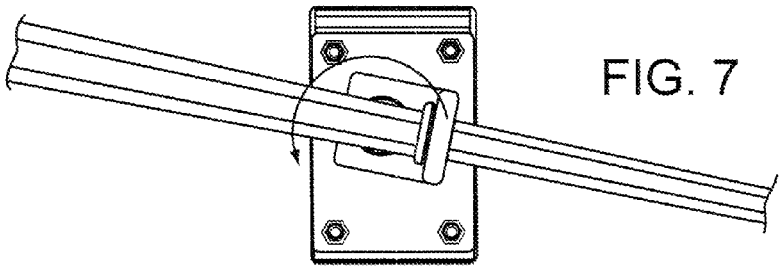

Horizontally oriented arm 24 of tool receiving member 20 has an opening 34 formed therethrough for receiving the shaft of a tool therein. Opening 34 is illustrated in FIG. 4 and also oriented in a substantially normal position in FIG. 1. Referring additionally to FIGS. 5 and 6, it can be seen that tool receiving member 20 can be pivoted slightly in one direction (clockwise in FIG. 5) to conveniently orient opening 34 to receive the end of a tool (in this specific example a sleever bar 40) therein. Once sleever bar 40 is completely inserted and released by the user/operator, the natural weight of the tool will automatically orient sleever bar 40 in a substantially vertical position, as illustrated in FIG. 6. Referring additionally to FIGS. 7 and 8, it can be seen that sleever bar 40 can be rotated substantially 160° from one side to the other so that sleever bar 40 can be moved out of the user/operator's way during normal working conditions. Also, sleever bar 40 can be rotated from one side to the other to allow pulling rather than lifting movements during extraction of the tool. This difference in movement (i.e. pulling vs. lifting) can save a worker a substantial amount of energy (work) throughout a day.

Thus, a new and improved belt mounted tool holder has been disclosed that is designed to receive and hold a variety of tools with different lengths and cross-sections. Specifically, the new and improved belt mounted tool holder is designed to receive and hold a variety of sleever bars therein. Further, the new and improved belt mounted tool holder is designed to allow swiveling movement of a tool held therein to enable easy access and pulling rather than lifting movements during extraction of the tool.

Various changes and modifications to the embodiment herein chosen for purposes of illustration will readily occur to those skilled in the art. To the extent that such modifications and variations do not depart from the spirit of the invention, they are intended to be included within the scope thereof which is assessed only by a fair interpretation of the following claims.

Having fully described the invention in such clear and concise terms as to enable those skilled in the art to understand and practice the same,

The invention claimed is:

1. A method for an operator wearing a belt to hold a sleever bar in a belt mounted sleever holder comprising the steps of:

providing a belt receiving member formed with an opening designed to receive a belt therethrough so as to securely hold the belt receiving member on a belt;

providing a mounting plate being a planar member and having an inner surface and an outer surface;

fixedly attaching the mounting plate to an outer surface of the belt receiving member by four bolts, with the inner surface of the mounting plate adjacent the belt receiving member;

pivotally attaching a sleever bar receiving member exterior to and ajdacent the outer surface of the mounting plate with a pivot pin, the sleever bar receiving member including a sleever bar receiving opening therethrough, the sleever bar receiving member being L-shaped and having a first arm and a substantially perpendicularly oriented second arm rigidly fixed with respect to the first arm, the first arm being pivotally attached parallel with an outer surface of the mounting plate for rotary movements of the first arm relative to the mounting plate, and the second arm including the sleever bar receiving opening therethrough;

positioning the belt receiving member and the mounting plate on the belt worn by the operator;

providing a sleever bar;

fixedly attaching a ring shaped stop member to the sleever bar intermediate a first end and a second end;

pivoting the sleever bar receiving member to provide access to the opening and inserting one of the first end and the second end of the sleever bar in the opening; and fully inserting the sleever bar into the opening of the sleever bar receiving member until the ring shaped stop member contacts the sleever bar receiving member, releasing the sleever bar, and allowing the sleever bar to pivot to a substantially vertical orientation, the weight thereof supported by the ring shaped stop member in contact with the sleever bar receiving member.

* * * * *